US005697144A

United States Patent [19]

Mitani et al.

[11] Patent Number: 5,697,144

[45] Date of Patent: Dec. 16, 1997

[54] METHOD OF PRODUCING A HEAD FOR THE PRINTER

[75] Inventors: Masao Mitani; Kenji Yamada; Katsunori Kawasumi; Kazuo Shimizu; Osamu Machida, all of Hitachinaka, Japan

[73] Assignee: Hitachi Koki Co., Ltd., Tokyo, Japan

[21] Appl. No.: 502,179

[22] Filed: Jul. 13, 1995

[30] Foreign Application Priority Data

| | | | |
|---|---|---|---|
| Jul. 14, 1994 | [JP] | Japan | 6-162151 |
| Aug. 26, 1994 | [JP] | Japan | 6-201985 |
| Dec. 9, 1994 | [JP] | Japan | 6-306076 |
| Jun. 1, 1995 | [JP] | Japan | 7-135185 |

[51] Int. Cl.[6] ..... H05B 3/00

[52] U.S. Cl. ..... 29/611; 216/27; 347/65

[58] Field of Search ..... 29/611; 216/27; 347/47, 59, 63, 65

[56] References Cited

FOREIGN PATENT DOCUMENTS

| | | |
|---|---|---|
| 48-9622 | 2/1973 | Japan . |
| 54-51837 | 4/1979 | Japan . |
| 59-138472 | 8/1984 | Japan . |
| 671888 | 3/1994 | Japan . |
| 6238901 | 8/1994 | Japan . |
| 6297714 | 10/1994 | Japan . |

OTHER PUBLICATIONS

"Design and Development of a Color Thermal Inkjet Print Cartridge"; Jeffrey P. Baker et al.; Hewlett–Packard Journal; Aug. 1988.

Nikkei Mechanical, Dec. 28, 1992 edition, pp. 58–63.

*Primary Examiner*—P. W. Echols

*Attorney, Agent, or Firm*—Whitham, Curtis, Whitham & McGinn

[57] ABSTRACT

To provide a method of fabricating, using thin-film processes only, a 1,600 dpi head with nozzles arranged two-dimensionally on a substrate, e.g., silicon wafer, a drive LSI, thin-film resistors and thin-film conductors are formed on the silicon wafer. Thereafter, ink channels and through-holes are formed by silicon anisotropic etching from both sides of the silicon wafer. After connecting the orifice plate to the silicon wafer, nozzles are formed in the orifice plate using photoetching.

19 Claims, 11 Drawing Sheets

A – A′ CROSS – SECTION

B – B′ CROSS – SECTION

C – C′ CROSS – SECTION

F – F′ CROSS – SECTION

G – G′ CROSS – SECTION

METHOD OF PRODUCING A HEAD FOR THE PRINTER

BACKGROUND OF THE INVENTION

1. Field of the Invention

The present invention relates to a printer and a method of producing a print head for the printer.

2. Description of the Related Art

Japanese Laid-Open Patent Publication (hereinafter referred to as "OPI publication") Nos. SHO-48-9622 and SHO-54-51837 describe an ink jet recording device wherein a portion of ink in an ink chamber is rapidly vaporized to form an expanding bubble. The expansion of the bubble ejects an ink droplet from an orifice connected with the ink chamber. As described in the August 1988 edition of Hewlett Packard Journal and the Dec. 28, 1992 edition of Nikkei Mechanical (see page 58), the simplest method for rapidly heating the portion of the ink is by applying an energizing pulse of voltage to a heater. Heaters described in the above-noted documents are constructed from a thin-film resistor and thin-film conductors covered with an anti-corrosion layer for protecting the resistor from corrosion damage. The anti-corrosion layer is additionally covered with one or two anti-cavitation layers for protecting the anti-corrosion layer against cavitation damage.

OPI publication No. HEI-6-71888 describes a protection-layerless heater formed from a Cr-Si-SiO or Ta-Si-SiO alloy thin-film resistor and nickel conductors. Absence of protection layers to the heater greatly improves efficiency of heat transmission from the heater to the ink. This allows great increases in print speed, i.e., in frequency at which ink droplets can be ejected. A print head wherein such heaters are used can be more simply produced.

Ink droplets can be ejected by applying only small amounts of energy to the heaters. The area surrounding the heaters will not be heated up by the small amount of energy applied thereto. Therefore, the LSI chip for driving the heaters can be formed near the heaters without fear of the LSI being damaged by overheating. OPI publication Nos. HEI-6-238901 and HEI-6-297714 describes an on-demand head with a simple monolithic structure wherein the LSI chip for driving the heaters is positioned near the heaters. The print head has many nozzles arranged two dimensionally at a high density. Also, the number of control wires is greatly reduced.

The present inventors realized that bubbles generated using the protection-layerless heaters have excellent generation and contraction characteristics. The present inventors also realized that these generation and contraction characteristics can greatly reduce cross-talk in a top-shooter or side-shooter thermal ink jet printer head driven using a new drive method. This indicates that the resistance to ink in the ink supply pathway can be reduced by shortening the length of individual ink channels for each nozzle. Since the ink supply pathway is shorter, the time to refill an ink chamber with ink after it is fired can be reduced so that printing speed can be increased.

The print head according to the present invention may appear to be analogous in structure to the print head described in OPI publication No. HEI-59-138472. However, where the OPI publication No. HEI-59-138472 describes a common channel for supplying ink to the ink ejection chambers as having a width in the range of 2 to 850 mm, the present invention has a common ink channel connected integrally to the individual ink channel formed in the same substrate, and the total width including the common ink channel and the individual ink channel is 0.2 mm.

SUMMARY OF THE INVENTION

It is an object of the present invention to provide a print head with a nozzle density of 1,600 dpi, which is three times or more than conventionally possible.

It is another object of the present invention to provide a method of fabricating, using thin-film processes only, a 1,600 dpi head with nozzles arranged two-dimensionally on a substrate.

It is still another object of the present invention to provide a method of forming a print head so that only the orifice plate is water resistant to the point where cleaning processes can be eliminated or greatly reduced.

To achieve the above and other objects, the present invention provides a method for fabricating an ink ejection head including:

a frame having a predetermined ink supply channel; and a head chip mounted on the frame, wherein the head chip is made from a silicon substrate and has:

a plurality of heaters each made from thin-film conductors and a thin-film resistor formed on a first surface of a silicon substrate;

a drive LSI formed on the silicon substrate and connected to each heater with a corresponding conductor for applying pulses of energy to a corresponding heater to generate heat at a surface of the corresponding heater;

an orifice plate formed with nozzles, each nozzle extending parallel or perpendicular to the surface of a corresponding heater so that bubbles generated by heat at the surface of each nozzle ejects ink droplets through the nozzles;

a plurality of individual ink channels provided on the silicon substrate in correspondence with each of the nozzles;

a common ink channel provided on the silicon substrate and connecting all the individual ink channels;

a single ink channel provided in the silicon substrate and connected with the entire length of the common ink channel; and at least one through-hole formed through a second surface of the silicon substrate, which is opposite the first surface of the silicon substrate, to connect the single ink channel to the first surface;

the method comprising the steps of:

forming the drive LSI on the first surface of the silicon wafer;

forming the thin-film resistors and the thin-film conductors to the first surface of the silicon wafer;

forming a partition wall formed with the ink channels in the first surface of the silicon wafer;

forming the ink channels and the through-hole by silicon anisotropic etching from both the first side and the second side of the silicon wafer;

connecting the orifice plate to the first surface of the silicon wafer;

forming the nozzles in the orifice plate using photoetching;

cutting the silicon wafer into head chips; and assembling the head chips to the frame and mounting wiring using die bonding techniques.

BRIEF DESCRIPTION OF THE DRAWINGS

The above and other objects, features and advantages of the invention will become more apparent from reading the following description of the preferred embodiment taken in connection with the accompanying drawings in which:

FIG. 2(*b*) is a cross-sectional view taken along lines B–B' of FIG. 1;

FIG. 2(*c*) is a cross-sectional view taken along lines C–C' of FIG. 1;

FIG. 12(*b*) is a diagram showing details of the processes for making an orifice plate according to the present invention.

DETAILED DESCRIPTION OF THE PREFERRED EMBODIMENTS

Figure 1:
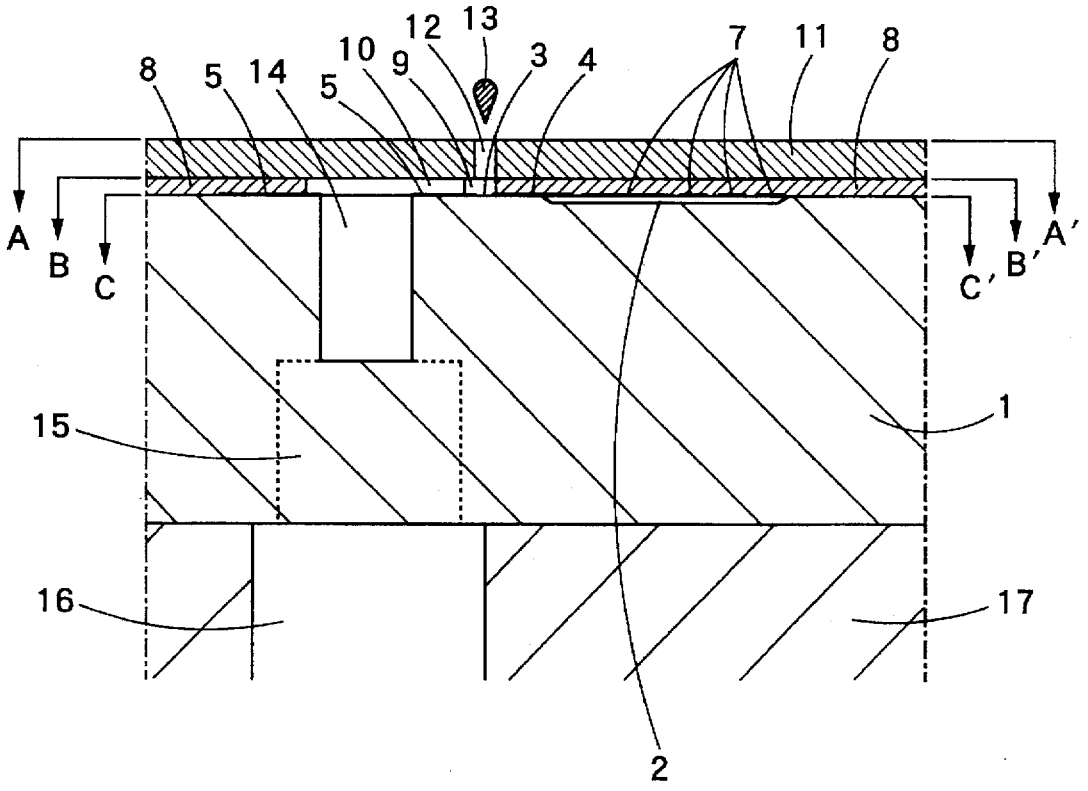
FIG. 1 is a cross-sectional view showing one nozzle 12 of a row of nozzles in an ink jet recording head according to a first embodiment of the present invention.

A printer and method of producing a print head for the printer according to a preferred embodiment of the present invention will be described while referring to the accompanying drawings wherein like parts and components are designated by the same reference numerals to avoid duplicating description.

Figure 2:
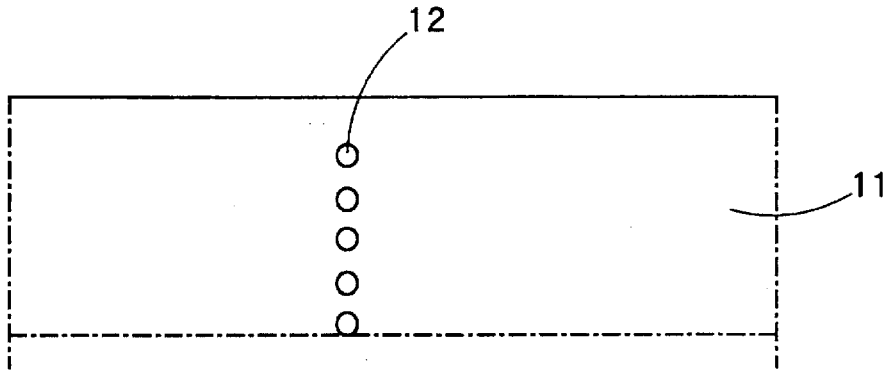
FIG. 2(*a*) is a cross-sectional view taken along lines A–A' of FIG. 1.
Figure 2:
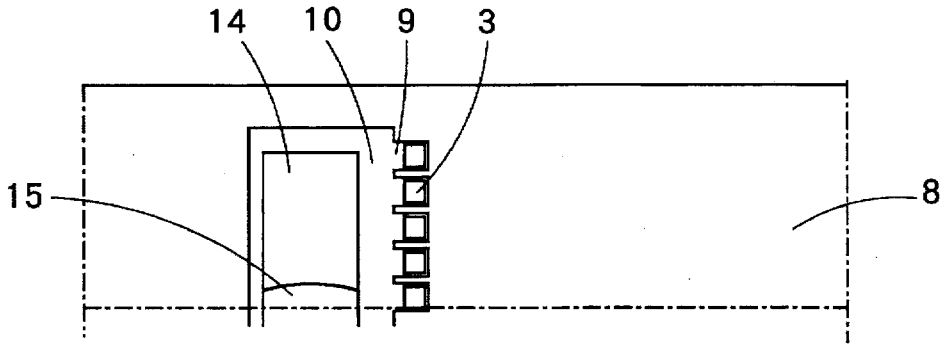
Figure 2:
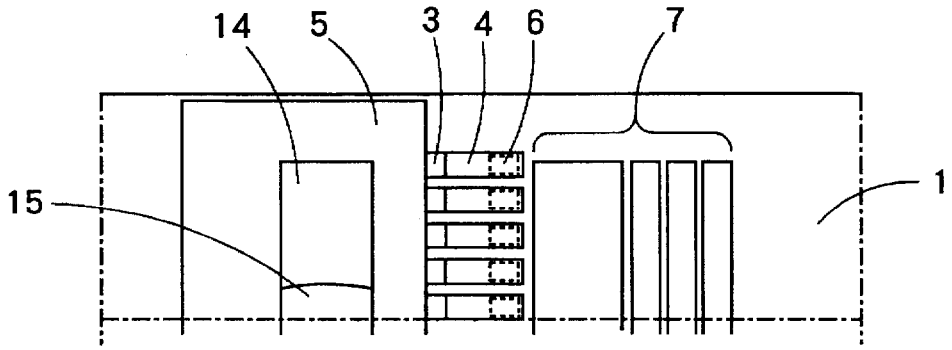

FIG. 1 is a cross-sectional view showing one nozzle 12 of a row of nozzles in an ink jet recording head according to a first embodiment of the present invention. The ink jet recording head has a nozzle density of 400 dpi. FIGS. 2(*a*), 2(*b*), and 2(*c*) are cross-sectional views taken along lines A–A', B–B', and C–C' respectively of FIG. 1. Processes for making this ink jet recording head will be described below while referring to FIGS. 1 through 9.

First Process

Using a slight modification of a standard bipolar LSI fabrication process for use on a (110) silicon wafer (e.g., substrate), a drive LSI device 2 is formed on a first surface of a (100) silicon wafer or of a (4° FF silicon wafer), which is a silicon wafer with a slant of 4 degrees compared to a (100) silicon wafer. It might be preferable to fabricate a BiCMOS or Power MOS type LSI device as the drive LSI device 2 depending on the cost of wafer production, chip size and yield, and other factors.

A $SiO_2$ film is formed to the surface of the silicon wafer during LSI fabrication processes. The $SiO_2$ film can be a thermal oxide film grown on the wafer, a film spun on as liquid glass using spin-on-glass (SOG) techniques, a phosphorus-doped $SiO_2$ (PSG) film, or an inter-layer $SiO_2$ film for use between multiple layers of aluminum wiring. Next, portions of the $SiO_2$ film where ink grooves 14 will be formed are removed using photoetching in order to prepare the surface for applying the photoresist used during anisotropic silicon etching of the ink grooves 14.

As shown in FIGS. 1 and 2, drive wiring conductors 7 for driving the thin-film heaters 3, which are formed in a second process to be described below, connect the LSI drive device 2 with an external source, not shown in the drawings, via connection terminals wired to one side of the substrate. Drive wiring conductors are provided for the power source, the ground, and for transmitting drive signals, such as data signals, clock signals, and latch signals. Individual wiring conductors 4 for each thin-film heater 3 are connected to the drive LSI device 2 via through-hole connection portions 6.

Second Process

An approximately 0.1 micron thick Cr-Si-SiO or Ta-Si-SiO alloy thin-film resistor and an approximately 1 micron thick nickel thin film are formed on the silicon wafer 1 using sputter techniques. Then the thin-film heaters 3 with resistance value of about 300 ohms, the individual wiring conductors 4, and a common thin-film conductor 5 are formed using photoetching techniques. These processes are described in detail in OPI publication No. HEI-6-71888, and so their explanation will be omitted here. The alloy thin-film resistor is formed using reactive sputter techniques in an argon atmosphere containing acid. The nickel thin film is formed using high-speed sputter techniques in a high magnetic field. The heaters and the silicon wafer are separated by an approximately 2 micron thick $SiO_2$ layer formed during fabrication of the LSI drive device 2. This $SiO_2$ layer forms a layer insulating the silicon wafer from the heat generated by the heaters.

Third Process

An approximately 20 micron thick layer of polyimide is accumulated on the first surface of the silicon wafer. Then a partition wall 8 is formed using photoetching techniques on an organosilicic resist. Dry etching, and more particularly reactive dry etching, allow etching with greater detail. The individual ink channels 9 and the common ink channel 10 were formed in clean shapes by etching the partition wall 8 using reactive dry etching with an oxygen plasma excited by an electron cyclotron resonance (ECR) source.

To form the partition wall 8 out of polyimide material, the surface of the silicon wafer 1 is coated with photosensitive polyimide, then the polyimide is exposed, developed, and hardened. Although presently available techniques can only produce a rather thin partition wall 8 of 10 microns, a thickness of more than 10 microns is desirable. However, to fabricate a high-density nozzle row of 800 dpi, 10 microns thick partition wall 8 suffices.

The partition walls 8 have never been formed from heat resistant resin. Conventionally, the partition wall in this position is formed from a photosensitive resist with low heat resistance. Because thermal pulses developed at the surface of the heaters can reach a temperature of 300° C. or greater, the heaters had to be formed at a position separated from the partition wall by about 10 microns to prevent damage to the partition wall. This structure limits nozzle density producible by conventional technology to about 400 dpi.

Figure 4:
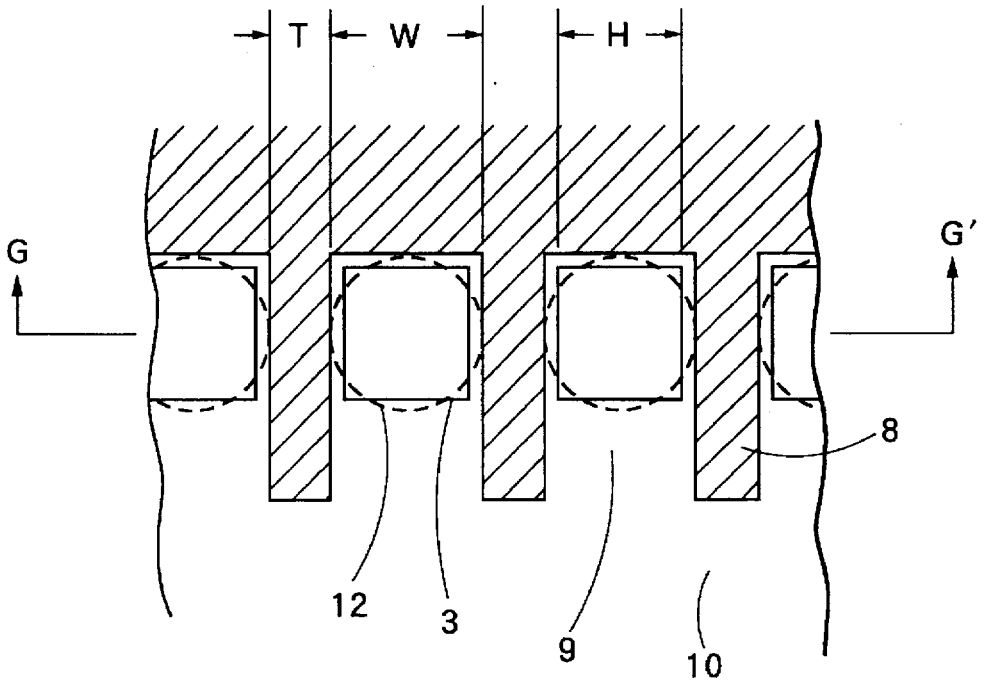
FIGS. 4(*a*) and 4(*b*) are is a cross-sectional view showing magnified details of an ink ejection head according to the present invention.
Figure 4:
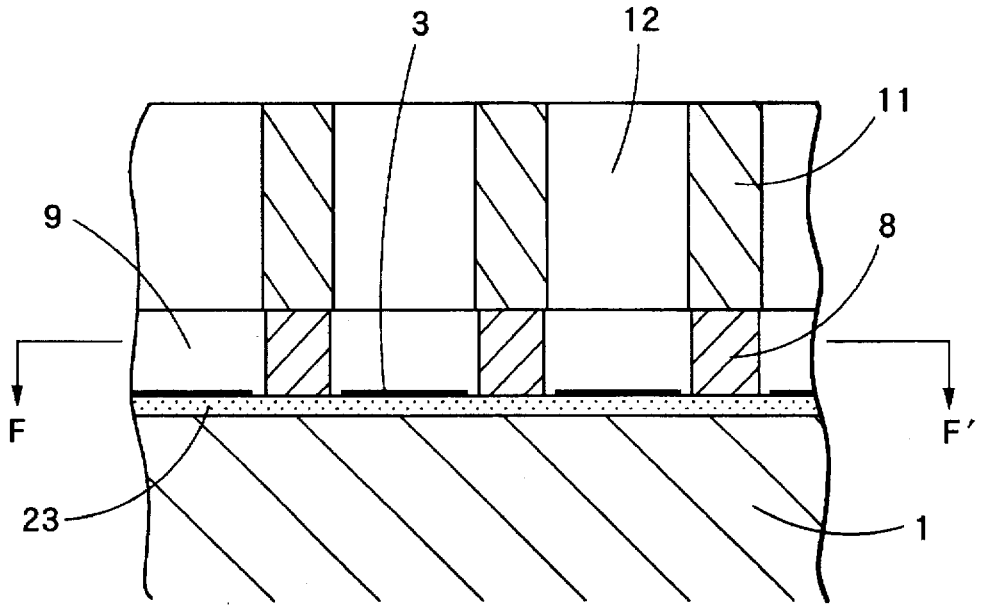

A highly reliable partition wall 8 can be made from a resin such as polyimide with high heat resistance and an initial thermal breakdown temperature of 400° C. Such a partition wall 8 will be reliable even if the temperature of the thin-film heaters 3 increases to 300° C. or more. A partition wall 8 sufficiently reliable to fabricate an 800 dpi head wherein dimensions T, W, and H shown in FIG. 4 are 9 microns, 22 microns, and 17 microns respectively, can be formed even taking deviations involved with photoetching into account.

Fourth Process

Figure 6:
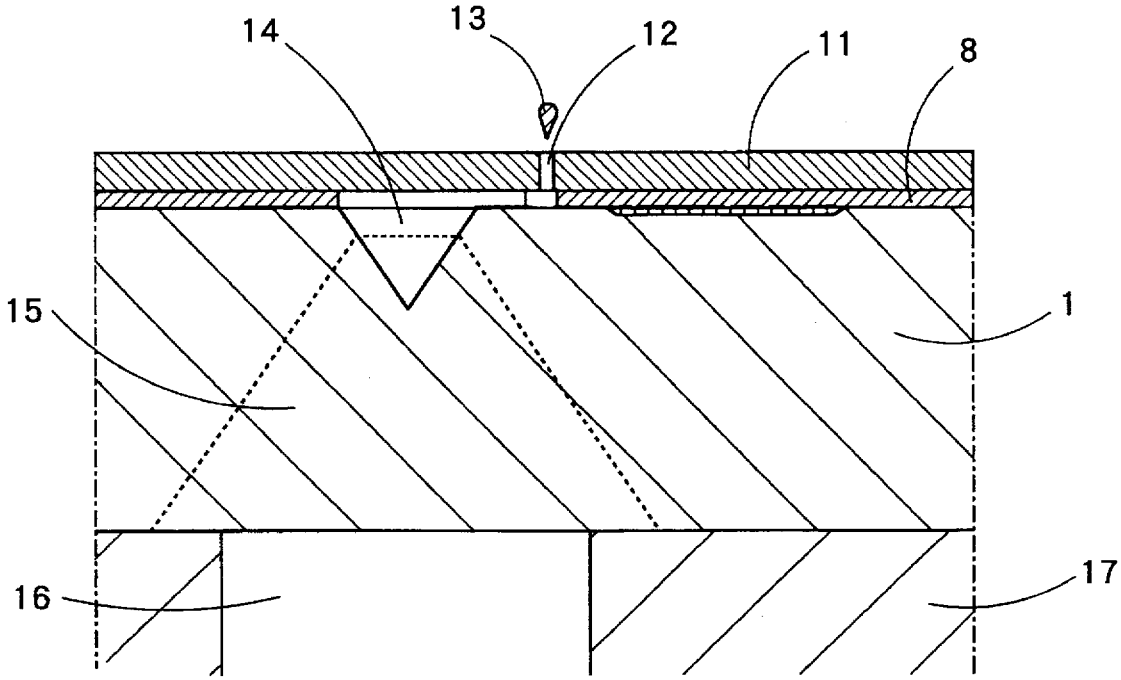
FIG. 6 is a cross-sectional view showing etching characteristic of a (100) silicon wafer, or (110) silicon wafer containing a 4 degree slant when forming another head according to the present invention.

A photoresist involved with formation of the through-holes 15 is formed on the rear surface of the silicon wafer 1. The ink grooves 14 and the through-hole 15 are formed simultaneously using silicon anisotropic etching from both sides of the wafer. Hydrazine aqueous solution, KOH aqueous solution, ethylene diamine aqueous solution, and the like can be used as the silicon anisotropic etching liquid. A (110) silicon wafer etches vertically as shown in FIG. 1. However, a (100) silicon wafer, or (110) silicon wafer containing a 4 degree slant, etches at a slant of about 55 degrees as shown in FIG. 6. Therefore, the openings for through-holes 15 need to be formed slightly wider at the surface of the silicon substrate than the minimum width desired for the through-holes 15. Anisotropic etch utilizes the fact that the etching speeds are extremely different between (110), (100) and (111) surfaces of a single crystal silicon. Therefore, some processing that is impossible using isotropic etching can be performed using anisotropic etching. The $SiO_2$ layer, that must be provided as an insulating layer between thin-film heaters 3 and the silicon wafer 1, is formed during processes to fabricate the drive LSI. The $SiO_2$ layer is used as a resist for anisotropic etching. Moreover, the ink grooves 14 and the through-holes 15 can be formed simultaneously in a single etching process.

Etching time must be shortened as much as possible to limit the amount that the anisotropic etching liquid also etches the nickel thin film or the polyimide partition wall. An effective method is to form a deep through-hole 15 on the second surface of the wafer using photo anisotropic etching while the first surface of the wafer is still protected with $SiO_2$ after the first and second processes. When anisotropic etching processes of the fourth process are performed on both surfaces of the wafer, the etching time required for forming the through-hole 15 can be reduced to ⅕ to 1/10 without risk of damage.

The ink grooves 14 should be made with a narrow width in terms of strength of the silicon wafer, flexure of the orifice plate 11, limitations of chip size, and other undesirable changes. However, the ink grooves 14 should be made with a broad width considering that wide ink grooves 14 reduce the number of through-holes 15 and reduce the resistance against ink flow caused by the array of ink grooves 14. Forming the ink grooves 14 to a width of between 100 and 200 microns will reduce the amount of resistance against ink flow produced by the common ink channel 10. If the ink grooves 14 and the through-hole 15 are to be formed with the same cross-sectional area, the minimal dimension of the through-holes 15 formed in the substrate surface should be in the range of from 300 to 600 microns width by from 600 to 1,000 microns length. Data on actual ink ejections will be discussed later.

Fifth Process

Figure 5:
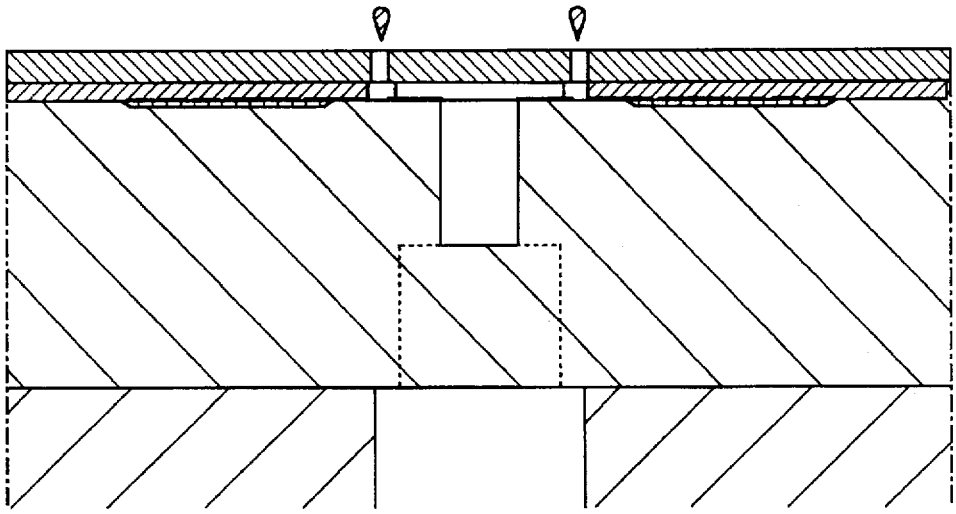
FIG. 5 is a cross-sectional view showing a full color line head with nozzle density of 1,600 dpi fabricated by forming two adjacent 800 dpi rows of nozzles with a single ink channel therebetween.

A full color line head with nozzle density of 1,600 dpi can be fabricated by forming two adjacent 800 dpi rows of nozzles with a single ink channel therebetween as shown in FIG. 5. However, the fifth and sixth processes described below are necessary for forming the nozzles in this way. The orifice plate 11 is formed by adhering and hardening a polyimide film, with thickness of about 60 microns including the approximately 10 micron thick layer of epoxy, to the first surface of the silicon wafer 1. The thickness of the film has an intimate relationship with ejected amounts of ink. The polyimide film should be between 20 and 80 microns thick when nozzle density is between 300 and 800 dpi.

Sixth Process

Ink ejection apertures 12 are formed in the polyimide film to a diameter of 40 microns directly above the thin-film heaters 3 at a density of 400 dpi using the same photo dry etching techniques described for the third process. It has been confirmed that ink ejection apertures with diameter of 20 microns can be cleanly formed at a density of 800 dpi using this reactive dry etching.

Conventionally, a thin orifice plate formed with many nozzle rows is aligned with and adhered to a substrate formed with an ink channel. The fifth and sixth processes improve alignment and fabricating yield over this conventional method. No other method can produce the large scale head shown in FIG. 5 with a high density of 800 dpi or 1,600 dpi. A long line head with slanted nozzles can be easily produced using processes described in the present embodiment. The substrate is mounted in the dry etching device at an angle between 3 to 10 degrees to the etching source. The ink ejecting apertures can be formed slanted at an angle 3 to 10 degrees from a line perpendicular to the surface of the aperture plate.

Seventh Process

The silicon wafer 1 is cut into predetermined dimensions to form a head chip.

Eighth Process

A print head is completed by die bonding lines of the head chip to a frame 17 preformed with ink supply channels.

Figure 3:
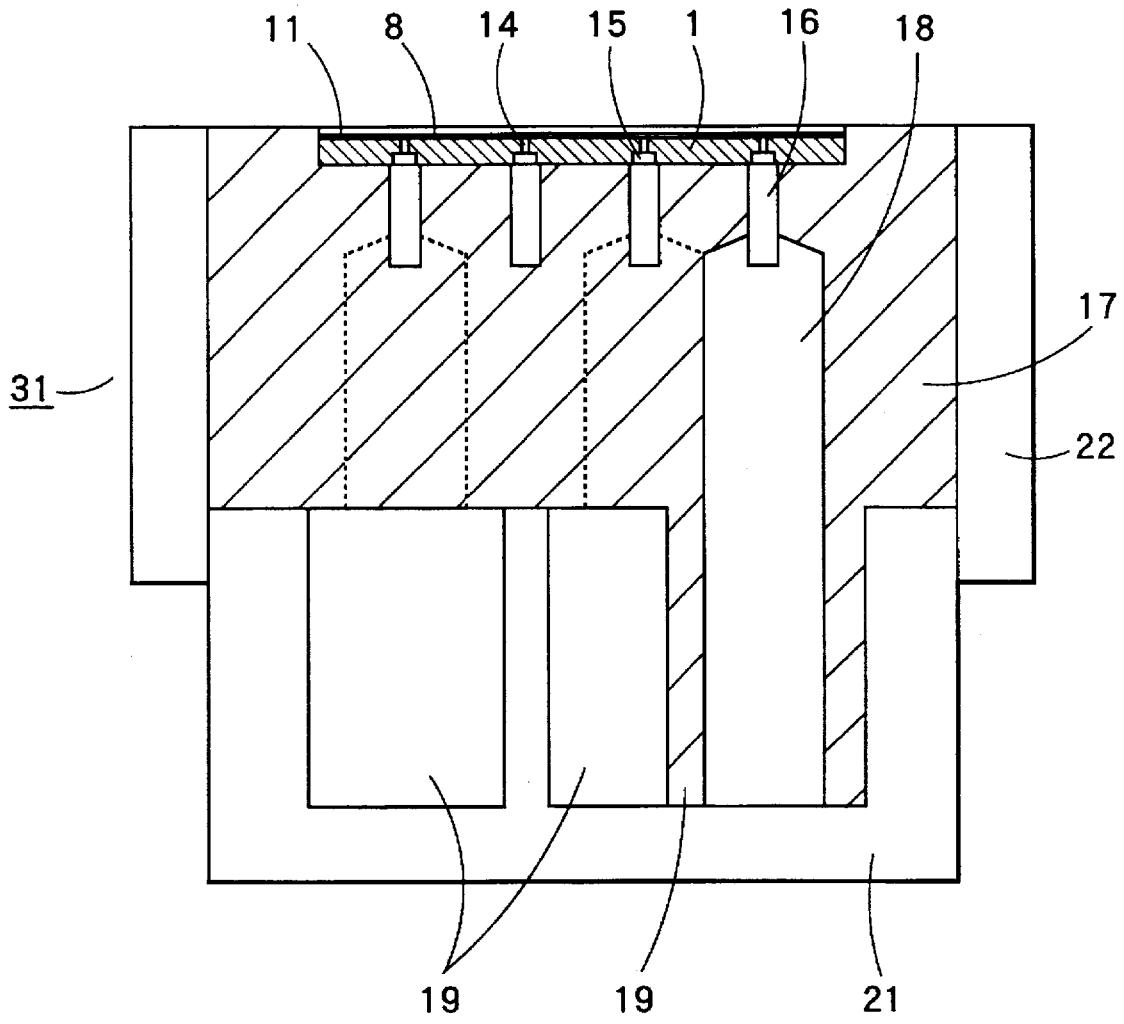
FIG. 3 is a cross-sectional view showing a line head for printing in full color on A4 sized sheets according to the present invention.

FIGS. 3, 7, 8, and 9 show an example of a line head for printing in full color on A4 size sheets. FIG. 3 is a cross-sectional view along line D–D' of FIG. 7. As shown in FIG. 1, the silicon wafer 1, the partition wall 8, and the orifice plate 11 form a head substrate for monochromatic printing. Four of the monochromatic head substrates are attached to the frame 17 using die bonding to form an integral heat chip 1, 8, 11 for printing in four colors: yellow, magenta, cyan, and black.

Figure 7:
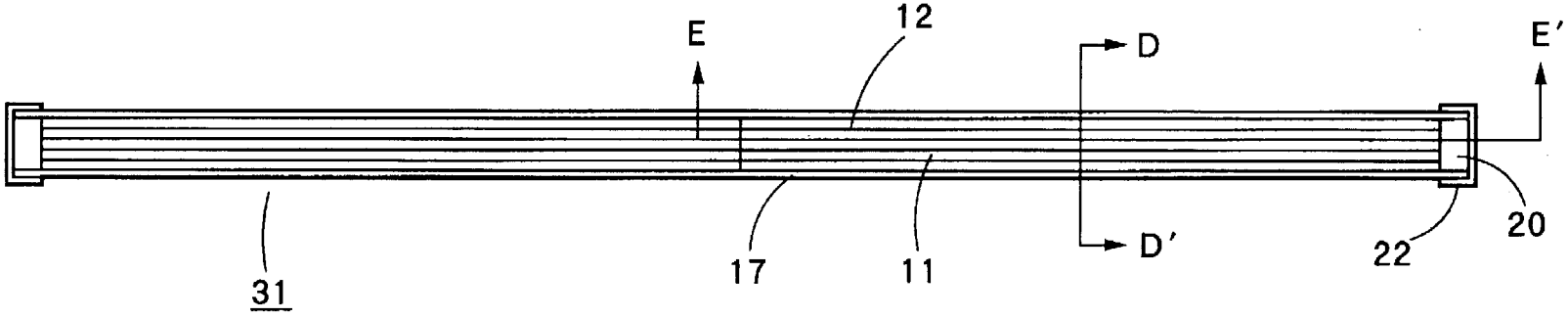
FIG. 7 is a front view showing the line head in FIG. 3.

The head chip 1, 8, 11 in FIG. 3 has a width of about 6.8 mm. As shown in FIG. 7, this includes four nozzle rows separated by about 1.6 mm. Each color of ink is supplied to ink channels 16 in the frame 17 through ink supply holes 18 of ink supply pipes 19 provided in the frame 17. Ink is supplied to the ink grooves 14 via through-holes 15 that are opened intermittently in the silicon wafer 1 so as to be parallel to the ink grooves 14 and the ink channels 16. One through-hole 15 is provided to supply every 100 to 300 ink ejection nozzles. The size and other details of the through-holes 15 will discussed later.

Although the present embodiment describes an example of a 400 dpi line head for printing in full color, the present invention can be applied to produce a scanning head with fewer nozzles or a head for printing in a single color, or in two or three colors.

Figure 8:
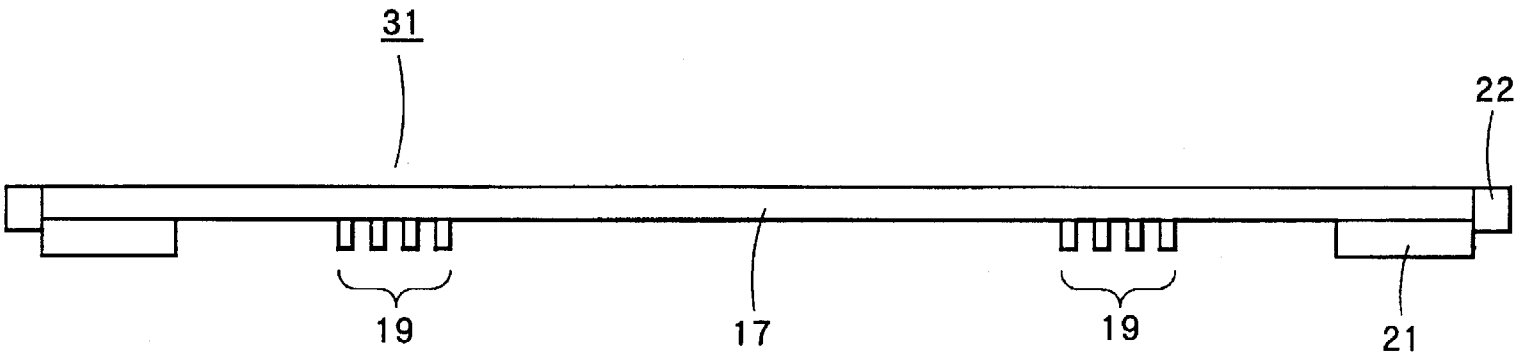
FIG. 8 is a side view showing the line head in FIG. 7.
Figure 9:
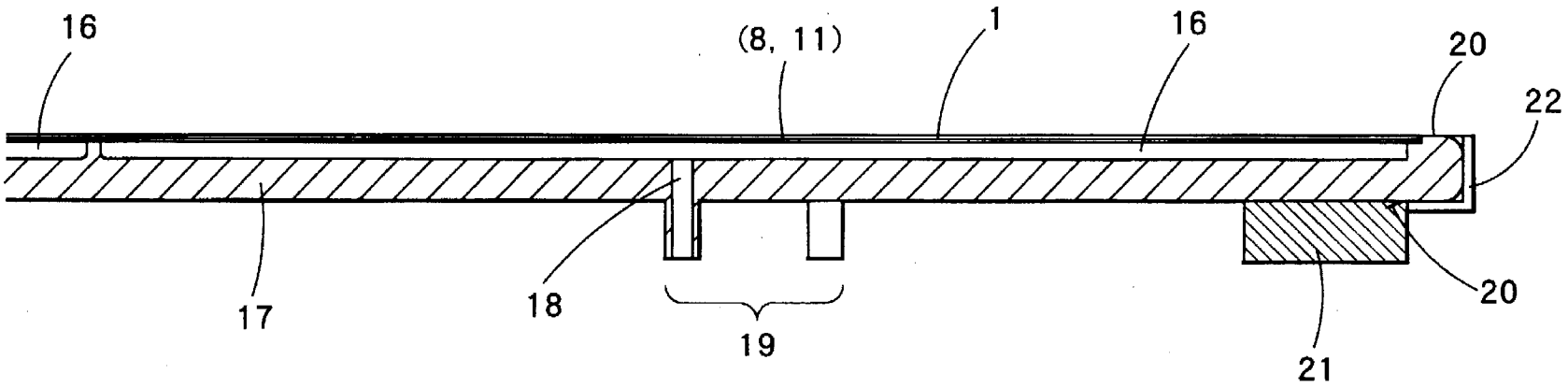
FIG. 9 is a cross-sectional view taken along line E–E' of FIG. 7.

FIG. 7 is an overhead view showing an external view of the orifice plate 11 of a line head for full color printing on A4 size sheets. FIG. 8 is a side view of the head shown in FIG. 7. FIG. 9 is an enlarged view of a cross-sectional view along line E–E' of FIG. 7. As shown in FIG. 7, each of the four aligned ink ejection nozzle rows 12 of the A4 full-color line head is about 210 mm long and has a density of 400 dpi. This head is fabricated from five or six inch wafers that are presently used in the semiconductor industry by first producing two half-sized line head chips 1, 8, 11 and assembling the two chips by aligning the ends of the two chips and die bonding them to a single frame 17. A tape carrier 20 at the right edge of the silicon wafer 1 connects signal lines and power lines, which are for driving the right side of the head, to a connector 21 fixed to the under side of the frame 17. The tape carrier 20 is fixed in place with the clip 22. The area where the wiring at the right edge of the silicon wafer 1 and the tape carrier 20 are bonded together is protected by a resin mold. However, detailed description of this process will be omitted here. Also, detailed description of the process for fabricating the inner portion of the connecter 21 will be omitted. The left side of the head is connected and mounted at the left edge of the frame 17 using the same processes as described above for the right side.

Ink supply and power supply can be performed independently for the left and right sides of this head. About five or six lines for the power source and signals of each color must be connected using the tape carrier 20. Therefore, a terminal density of about four lines/mm must be gang bonded at the edge surface of the chip heads. This density is easily obtainable with connection mounting techniques.

Figure 10:
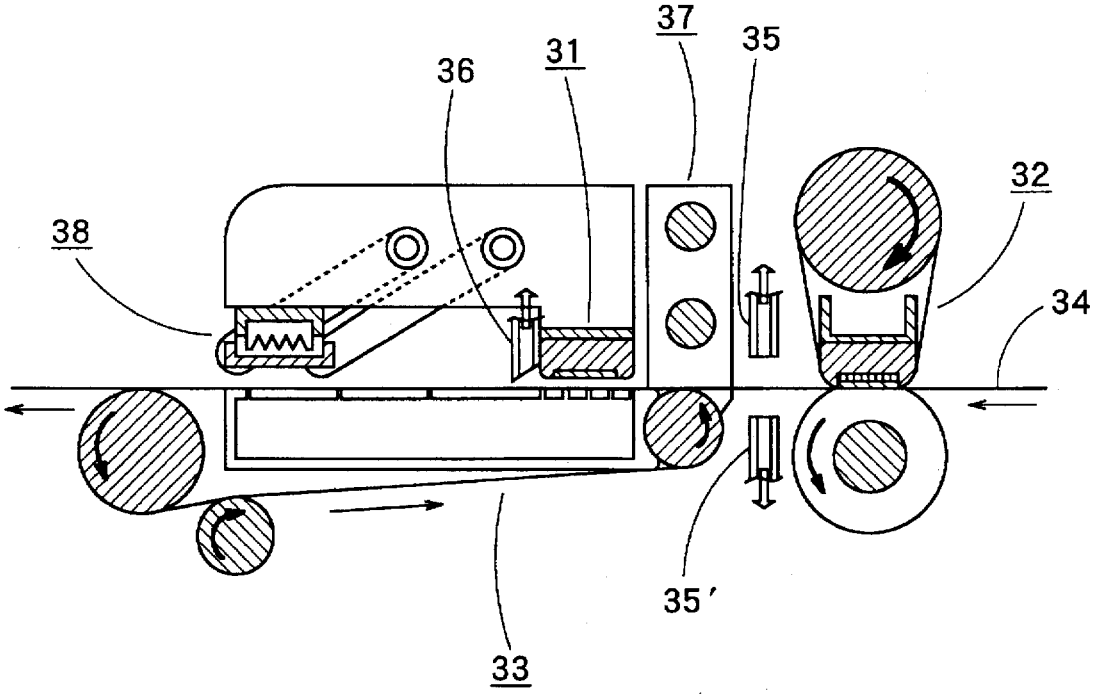
FIG. 10 is a cross-sectional view showing a high-speed full color printer in which heads according to the present invention were mounted for performing evaluation tests on the heads.

FIG. 10 is a cross-sectional view showing an embodiment of an A4 full-color printer using a line head 31 produced as described above. Using the preheating and suction-vacuum sheet transport techniques described in these applications, 20 to 30 pages of high quality full-color images can be printed on normal print sheets and dried about 100 times more rapidly than conventionally possible.

Line heads fabricated under various conditions were mounted to the printer shown in FIG. 10 and evaluated in printing tests. The heaters of the line heads were driven with an energy density of 2.5 W/50 $\mu m^2 \times \mu S$. This is the drive condition required to produce fluctuation boiling. First odd nozzle rows were serially driven with a time lag of 0.2 microseconds between rows. Subsequent to this, even nozzle rows were serially driven with the same time lag of 0.2 microseconds between rows. The left side and the right side of the head were driven simultaneously. One line's worth of printing, that is, 3,340 dots each for four colors, is completed in about 0.34 milliseconds. This drive method prevents ejected ink droplets from coupling in flight. This drive method prevents cross talk. High-quality printing is possible with this drive method. The recording sheet was transported at a speed of one line every 0.7 ms when printing was performed at an ink ejection frequency of about 1.5 KHz. This corresponds to a printing speed of about 16 pages of A4 size paper every minute.

The evaluated 400 dpi line heads were fabricated for printing in full color on A4 size sheets. The silicon substrates (wafers) used had a thickness of 400 microns. Line heads made using a (110) silicon substrate were formed with 100 micron wide ink grooves 14 and 300 micron wide and 600 micron long through-holes 15. Both the ink grooves 14 and the through-holes 15 were formed to a depth of 200 microns or more. Line heads made using a (100) silicon substrate or a 4 degree off silicon substrate were formed with ink grooves 14 having an opening width of 200 microns and with through-holes 15 having an opening width of 600 microns and length of 1,000 microns. The substantial cross-sectional area of the ink grooves 14 and the through-hole 15 was kept to about the same as that formed in the (110) silicon substrate so that evaluations could be performed with resistance to ink flow in these ink channels at uniform conditions. The ink channels 16 on the frame were formed to a width of about 500 microns and to a thickness of about 2,000 microns. The ink supply holes 18 were formed with a diameter of 2,500 microns.

The head of the present embodiment was evaluated as to whether or not ink was smoothly supplied with this structure. The objective of these test was to determine the maximum number of nozzles a single connection hole could supply ink to when printing at a slow ink ejection frequency of about 1.5 KHz. Heads wherein each through-hole supplied ink to 200, 300, and 400 nozzles were made. Printing was performed at printing duties of 25%, 50%, 100%. Reduction in image density caused by deficient ink supply are shown in table 1.

TABLE 1

| NOZZLES/ CONNECTION | PRINTING DUTY (%) | | |
|---|---|---|---|
| HOLE | 25 | 50 | 100 |
| 200 | NO CHANGE | NO CHANGE | NO CHANGE |
| 300 | NO CHANGE | NO CHANGE | SLIGHT CHANGE |
| 400 | NO CHANGE | SLIGHT CHANGE | CHANGE |

Almost the same results were obtained using a print head made from a 100 silicon substrate. When ink grooves 14 and through-holes 15 are provided with this range of surface area, one connection hole should be sufficient for every 300 nozzles for printing at a low ejection frequency. However, when printing at a high ejection frequency, one connection nozzle should be provided for every 200 to 250 nozzles.

Tests were performed using the 1,600 dpi head shown in FIG. 5 with the same ink grooves 14 and through-holes 15. Nozzles were formed with a diameter of 20 microns. Each side of the head had a nozzle density of 800 dpi. Ink droplets were ejected at a frequency of 1.5 KHz, that is, at a printing speed of about four A4 size sheets per minute. The results were the same as shown in Table 1. These results could be anticipated because the ink amount ejected from each nozzle over each unit of time is the same as the 400 dpi head or the 600 dpi head. No deterioration was observed in quality of characters printed during long-term continuous printing using the 1,600 dpi head. These results can be attributed to the partition wall being made from polyimide, which is an excellent heat-resistant resin; use of protection-layerless heaters that do not overheat the partition wall; and structure of the head that prevents changes in printing density even if the temperature of the head changes. The head fabricating process including photo dry etching of the present invention is the first to allow production of a 1,600 dpi head.

The line head described above is sufficient for printing with an ejection frequency of 1.5 KHz. However, to insure smooth supply of ink to the frame, it is desirable to provide twice the ink supply ports 18 when printing at an ejection frequency of 5 KHz and three times the ink supply ports 18 when printing at an ejection frequency of 10 KHz.

The following is a description of a second embodiment of the present invention. Increases in ejection frequency reduce the number of nozzles that each connection hole can cover the ink supply needs for. To investigate this, a serially scanning type head was made with virtually the same structure as described in the first embodiment, but with four rows of 512 nozzles. The quality of characters printed with the head at an ejecting frequency of 10 KHz were evaluated. This head could be produced from a single chip on a single frame, in contrast to the head of the first embodiment, which was produced from two chips on a single frame. Nozzles of odd rows were serially fired every 0.2 microseconds. In succession with this, nozzles of even rows were serially fired every 0.2 microsecond. Therefore, all 512 nozzles were fired in 102 microseconds. Heads were produced with one through-hole 15 for every 100, 150, and 200 nozzles. Tests were performed at printing duties of 25%, 50%, and 100%. The results of the tests are shown in Table 2. It can be seen that providing one connection hole for every 100 nozzles is sufficient.

TABLE 2

| NOZZLES/ CONNECTION | PRINTING DUTY (%) | | |
|---|---|---|---|
| HOLE | 25 | 50 | 100 |
| 200 | NO CHANGE | NO CHANGE | SLIGHT CHANGE |
| 300 | NO CHANGE | SLIGHT CHANGE | CHANGE |
| 400 | SLIGHT CHANGE | CHANGE | CHANGE |

Extreme reductions in bending strength must be avoided to prevent damage to chip heads during their fabrication and assemblage. It is desirable therefore to provide narrow ink grooves and to provide as few connection holes as possible. The above-described embodiment indicates the best balance between ink groove size and connection hole size. Based on this balance, the optimum number of connection holes was determined. Therefore, if the ink grooves and the through-holes are made larger, the number of through-holes should be slightly lessened.

The following is a description of a third embodiment of the present invention. The nickel thin-film conductor has a greater electrical resistivity than a conductor made from aluminum or other metals. The thickness of the thin film must be increased to prevent the resistance of the wiring from increasing when forming a large-scale line head or when the common thin-film conductor is long.

However increases in the thickness of the conductor thin film induces the following problems. For example, a high temperature is developed at the substrate when forming the nickel film using sputtering techniques. Also, high-speed electrons and ions infused into the film expand the film and therefore increase its volume, resulting in compressive stress remaining in the nickel film. Therefore, the thicker the film is made, the more the stress increases in the film, the easier the film peels away from the substrate, the easier the substrate deforms, and the easier damage occurs.

Also, it takes a long time to make a thin film using sputtering techniques. Therefore, energy consumption increases and productivity drops.

Additionally, etching processes for forming semiconductor patterns after forming conductor films take longer by an amount proportional to the thickness of the conductor film. The number of rejects increases due to poor resolution of the semiconductor pattern and peeling of the photoresist caused by the longer etching time increasing the amount etched from the sides of the semiconductor patterns.

The third embodiment overcomes these problems. Processes for forming the nickel thin film conductor will be described below. All other processes are the same as described in the first embodiment so their explanation will be omitted.

Figure 11:
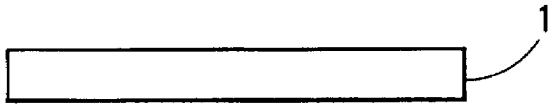
FIGS. 11(*a*) through 11(*g*) are explanatory diagrams of processes for producing the thin-film resistors and the thin-film conductors according the present invention.
Figure 11:
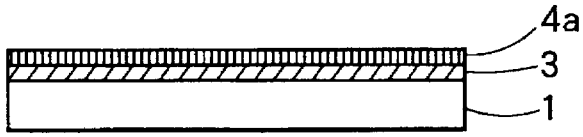
Figure 11:
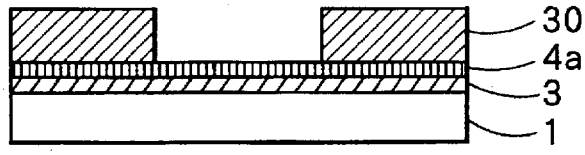
Figure 11:
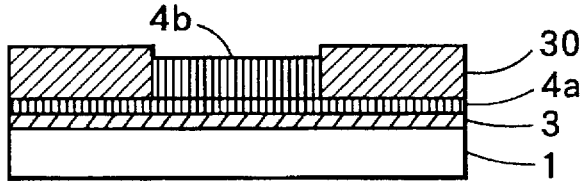
Figure 11:
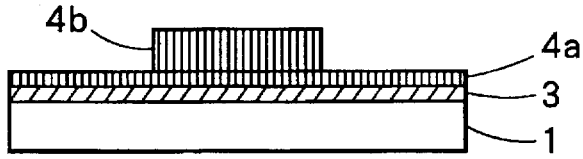
Figure 11:
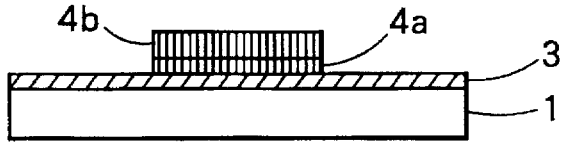
Figure 11:
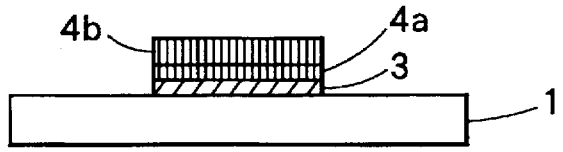

FIG. 11(*a*) shows a silicon wafer 1 on which is formed an approximately 1 micron thick layer of $SiO_2$. FIG. 11(*b*) shows a Cr-Si-SiO alloy thin-film heater 3 formed on the layer of $SiO_2$ and a nickel thin-film conductor 4*a* formed on the thin-film heater 3 by successive sputtering processes. Although not shown in the drawings, a corresponding nickel thin-film conductor is also formed on the thin-film heater 3 in confrontation with the nickel thin-film conductor 4*a*. Each of these thin films is about 0.1 micron thick. The compressive stress of a 0.1 micron thick nickel thin film is small enough to ignore.

FIG. 11(*c*) represents processes wherein a photoresist 30 is coated on the thin-film heater 3 and the conductor 4*a* and the corresponding nickel thin-film conductor. After the photoresist 30 is exposed and developed, the thickness of the photoresist 30 needs to be greater than the nickel plate thin-film conductor 4*b* and the corresponding nickel thin-film conductor to be formed in the next process. For forming the nickel plate thin-film conductor 4*b* and the corresponding nickel thin-film conductor to a thickness of 2 microns, the photoresist 30 of the present embodiment was formed to a thickness of 5 microns. The photoresist used was PMERP-AR900 resist for plate thick film produced by Tokyo Oka. The same processes can be performed using a different type of resist, for example, a dry film resist such as Photec SR-3000 produced by Hitachi Kosei.

Next, to prepare the substrate for plating processes, the substrate is immersed in 5% solution of hydrochloric acid for ten minutes. Then the surface of the nickel plate thin-film conductors 4*a* and 5*a* are photoetching. The substrate is washed after light etching.

FIG. 11(*d*) represents processes wherein the nickel plate thin-film conductor 4*b* and the corresponding nickel thin-film conductor are formed by plating to the portion not covered with photoresist 30, that is, to the conductor portion. As shown in Table 3, plating of the present embodiment was performed using sulphonamine acid nickel as the main constituent of the plating solution.

TABLE 3

| | |
|---|---|
| COMPOSITION OF PICKLING BATH | Sulphonamine acid nickel 400 g/l<br>Nickel chloride 20 g/l<br>Boric acid 40 g/l |
| Bath temperature | 50° C. |
| pH | 4.0 |
| Current density | 2.5 A/dm$^2$ |

A 2 micron thick nickel film could be formed by plating for four minutes. The nickel film could also be formed using a watt plating liquid with nickel sulphate as the main constituent or a nickel chloride solution with nickel chloride as the main constituent.

Next the photoresist is peeled off in the process depicted in FIG. 11(*e*). The nickel plate thin-film conductors 4*b* and 5b formed in this way have a conductor width of 40 microns and are separated by 22 microns.

Next, in the process depicted in FIG. 11(f), the substrate of FIG. 11(e) is immersed for one minute in an etching liquid including a mixture of nitric acid, acetic acid, and sulfuric acid so that the entire exposed portion of the nickel plate thin-film conductors 4a and 5a that was formed by sputtering a 0.1 micron thick layer of nickel etched away with about 0.1 microns of the surface of the nickel plate thin-film conductors 4b and 5b. This forms the nickel conductor portion. Defects formed at edge portions of the nickel plate thin-film conductors 4b and 5b formed during these plating processes are also removed during this etching process.

The pattern for the Cr-Si-SiO alloy heater is formed in the process depicted by FIG. 11(g) by etching. The etching liquid is 5% solution of hydrofluoric acid. A Ta-Si-SiO alloy heater could be formed instead of the Cr-Si-SiO alloy heater to achieve the same results. This method allows effective fabrication of a thick nickel thin-film conductor. Afterward, the processes described in the third process and subsequent processes of the first embodiment are followed.

Figure 12:
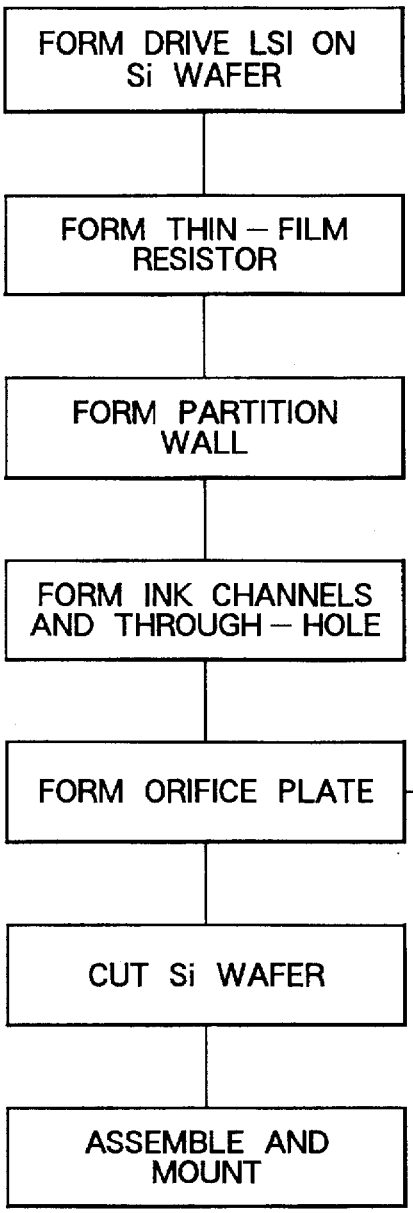
FIG. 12(*a*) is a diagram showing details of the processes for making a head according to the present invention.
Figure 12:
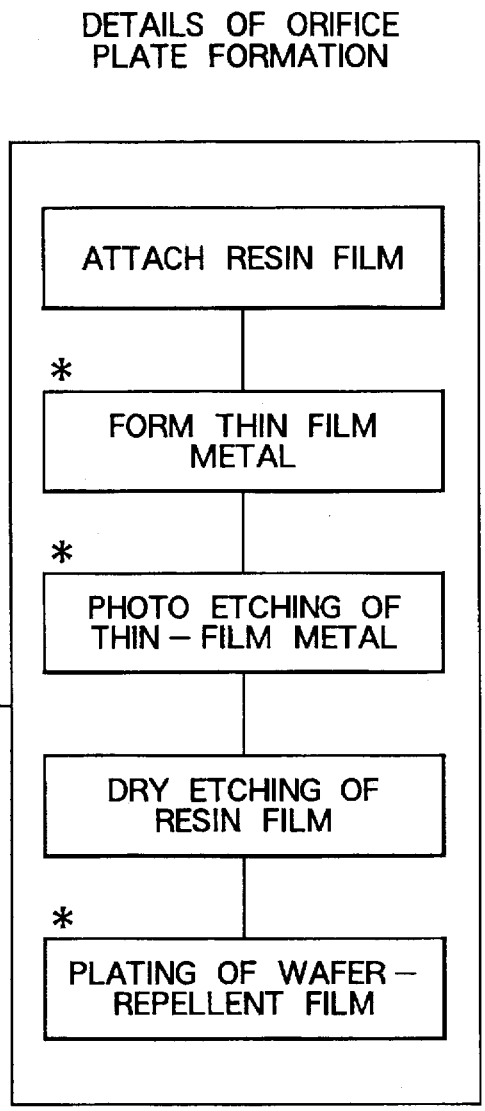
Figure 13:
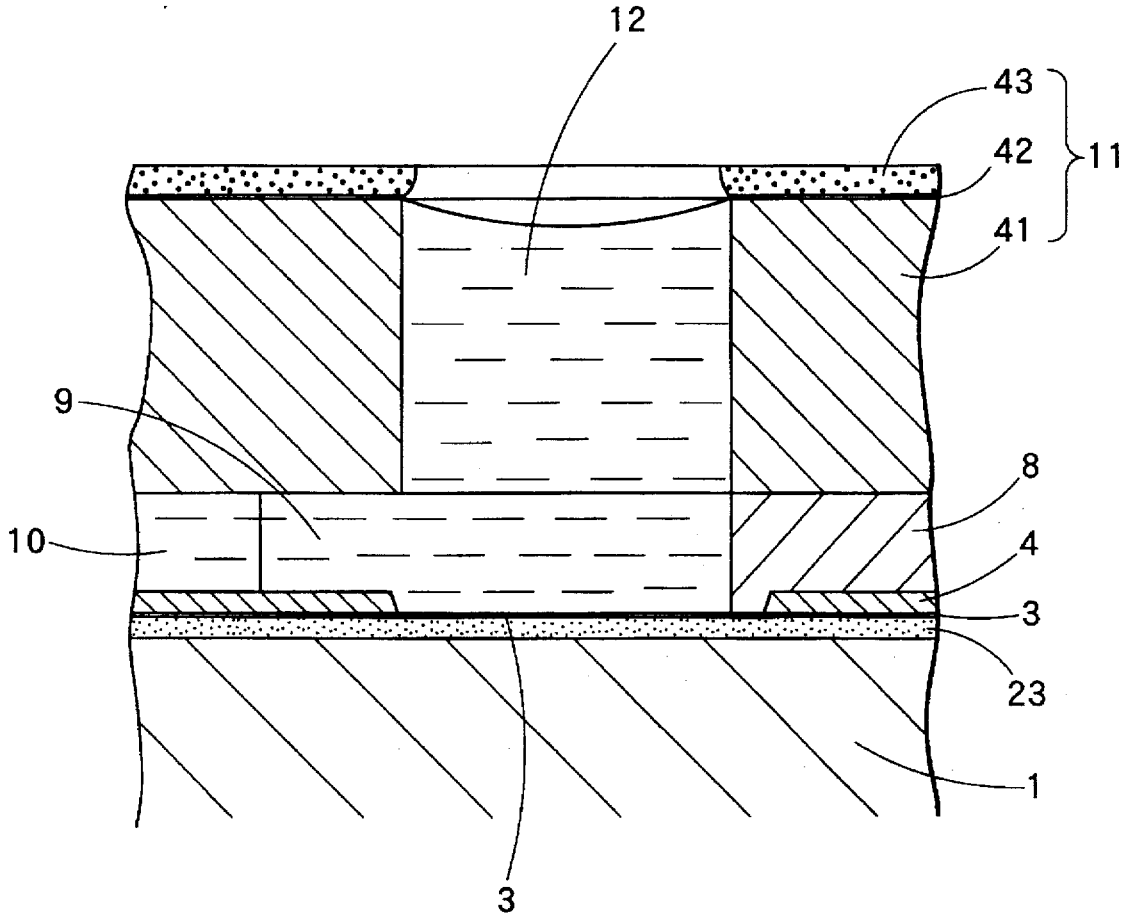
FIG. 13 is a cross-sectional view showing the area around the orifice plate formed by processes described in FIG. 12(*b*).

The following is an explanation of a fourth embodiment of the present invention wherein only the surface layer of the orifice plate is coated with a water-repellent film. FIG. 12(a) schematically shows processes of a fabrication method for the head described in the first embodiment. The orifice plate 11 of the head in the first embodiment is constructed of only a heat-resistant resin plate. On the other hand, as shown in FIG. 13, the orifice plate 11 of the head of the present embodiment further includes a metal thin film 42 formed to a desired thickness between 0.05 to 1.0 microns on the resin film 41; and a water-repellent film 43 with a desired thickness between 0.01 and 5 microns fixedly attached to the surface of the metal thin film 42. A process for fabricating this structure will be described below while referring to FIG. 12(b).

An approximately 0.1 micron thick nickel thin film 42 is formed on the structure formed by the first through fifth processes of the first embodiment. Holes are formed in the nickel thin film 42 at areas corresponding to the ink ejection apertures using photoetching with an organosilicic resist. Nozzle holes 12 are opened at right angles to the polyimide film 41 using dry etching with an oxygen plasma induced by an electron cyclotron resonance source. The nozzle holes 12 can be opened at an optional angle which is essential when assembling and mounting two chips on a common frame to make the line head shown in FIG. 7. Next, the organosilicic resist is removed. The water-repellent film 43 is formed only on the surface of the nickel thin film 42 using a plating method wherein the nickel thin film 42 serves as a plating electrode. The method of forming a water-repellent film 43 by plating is well known as composite plating. The film produced by plating with a nickel plating liquid in which is dispersed a fluorocarbon resin or graphite fluoride particles has excellent water repellency, which, as described on page 477 of the 46 vol #7 of Kagaku, results in an angle of contact near 180 degrees.

An orifice plate was made by covering the polyimide film 41 with a compound nickel plating film, that shows the same angle of contact as a fluorocarbon resin (PTFE), that is, about 110 degrees, and by covering the compound nickel plating film with a nickel plated film containing graphite fluoride, that shows an angle of contact of about 140 degrees. All nozzles ejected the same amounts of ink. The amount of ink clinging to the orifice surface was reduced so as to eliminate the need to clean the orifice surface. The graphite fluoride compound nickel plate film required especially little cleaning. This film can contribute to production of a printer that requires no cleaning of the orifice surface.

Some of the sputtering processes depicted in FIG. 12(b) can be eliminated by using a two-layer polyimide film structure with a preformed metal thin-film. Other metals, even those susceptible to corrosion by ink, can be used instead of nickel for the metal thin film because its surface will be covered and protected by the compound nickel plate film.

The nickel thin film 42 will be sufficiently thick to function as a plating electrode if formed to a thickness of 0.05 to 1 micron on the polyimide film 41. Thin water-repellent films 43 have been developed that can be formed by plating to a thickness of 100 angstroms, or about 0.01 microns. These thin water-repellent film 43 are formed using a method wherein a fluoride compound and an organophosphoric acid bond in a plating liquid made from an organic complex of a fluoride compound. With this method the surface layer only of the orifice plated can be covered by water-repellent film to a desired thickness of 0.01 to 5.0 microns. Also, the resultant water-repellent film shows an angle of contact of 180 degrees which completely repels water. A water-repellent film in which fluoride resin particles are dispersed and which shows an angle of contact of 170 degrees, which eliminates the need for head cleaning, can be formed to a thickness of only a few microns using fluorocarbon electrodeposition.

The present invention allows elimination of several processes because a $SiO_2$ layer formed during formation of the drive LSI can be used as the heat insulating layer of the heaters and also because the ink channels can be formed using a photomask.

The present invention allows forming the ink channels and through-holes in the same processes so that the overall number of process can be reduced.

Because apertures are formed in the orifice plate by photoetching after the orifice plate is adhered, the heaters and the apertures can be easily aligned. This allows production of a 1,600 dpi head, which is three times larger than conventional heads.

Cylindrical orifices can be formed by using reactive dry etching for the photoetching method of the orifice plate. This prevents changes in print density caused by changes in temperature.

Also, the cylindrical apertures can be formed at a slant of 3 to 20 degrees, which is necessary to fabricate a long line head.

Because relatively few through-holes are provided following the direction of narrow ink grooves, problems that lower yield, such as cracking of the silicon wafer, can be prevented.

Because the surface of the orifice plate is provided with a water-repellent layer, head cleaning process can be reduced or eliminated.

Because several tens or several hundreds of thousands of nozzles can be formed at once using only thin-film processes on a silicon wafer, a large-scale high-density head can be inexpensively fabricated.

A printer fabricated according to the present invention does not require head temperature control, drive pulse width control, or color balance control.

While the invention has been described in detail with reference to specific embodiments thereof, it would be apparent to those skilled in the art that various changes and modifications may be made therein without departing from the spirit of the invention, the scope of which is defined by the attached claims.

What is claimed is:

1. A method for fabricating an ink ejection head including:

a frame having a predetermined ink supply channel; and a head chip mounted on the frame, wherein the head chip is made from a silicon substrate and includes:

a plurality of heaters each made from thin-film conductors and a thin-film resistor formed on a first surface of the silicon substrate;

a drive large-scale-integrated circuit (LSI), formed on the silicon substrate and connected to each heater with a corresponding conductor, for applying pulses of energy to a corresponding heater to generate heat at a surface of the corresponding heater;

an orifice plate formed with nozzles, each nozzle extending perpendicular to the surface of a corresponding heater so that bubbles generated by heat at the surface of each heater eject ink droplets through the nozzles;

a plurality of individual ink channels provided on the silicon substrate in correspondence with each of the nozzles;

a common ink channel provided on the silicon substrate and connecting all the individual ink channels;

an ink groove provided in the silicon substrate and connected with an entire length of the common ink channel; and at least one through-hole formed through a second surface of the silicon substrate, which is opposite the first surface of the silicon substrate, to connect the ink groove to the first surface, the method comprising steps of:

forming the drive LSI on the first surface of the silicon substrate;

forming the thin-film resistors and the thin-film conductors on the first surface of the silicon substrate;

forming a partition wall including the ink channels and the at least one through-hole in the first surface of the silicon substrate, said ink groove and said at least one through-hole being formed by silicon anisotropic etching from both a first side and a second side of the silicon substrate;

connecting the orifice plate to the first surface of the silicon substrate;

forming the nozzles in the orifice plate using photoetching;

cutting the silicon substrate into a plurality of head chips; and assembling the head chip to the frame.

2. A method as claimed in claim 1, wherein the silicon substrate comprises a single crystal silicon wafer with a crystal orientation of (100) or (110).

3. A method as claimed in claim 1, wherein the thin-film resistor comprises a Cr-Si-SiO or a Ta-Si-SiO alloy thin-film resistor formed by sputtering, and wherein the thin-film conductor comprises a nickel thin-film conductor formed by high-speed sputtering.

4. A method as claimed in claim 3, wherein the nickel thin-film conductor is formed using high-speed sputtering and electroplating.

5. A method as claimed in claim 4, wherein the nickel thin-film conductor is formed by:

forming a first nickel thin-film using high-speed sputtering;

photoetching a surface of the first nickel thin-film; and electroplating a second nickel thin-film onto the first nickel thin-film.

6. A method as claimed in claim 1, wherein the step of forming said partition wall comprises forming the partition wall of a heat-resistant resin having a thermal breakdown starting temperature of 400° C. or more.

7. A method as claimed in claim 6, wherein the heat-resistant resin comprises polyimide.

8. A method as claimed in claim 1, wherein the step of connecting said orifice plate comprises providing an orifice plate comprising a thermal-resistant resin plate, and wherein reactive dry etching is used for the photoetching process to form the nozzles.

9. A method as claimed in claim 8, wherein the orifice plate is formed by:

adhering the thermal-resistant resin plate to the silicon substrate;

forming a metal thin film to a surface of the thermal-resistant resin plate;

photoetching portions of the metal thin film that correspond to the nozzles;

reactive dry etching portions of the thermal-resistant resin plate that correspond to etched portions of the metal thin film; and electrodepositing a water-repellent film to a surface of the metal thin film by using the metal thin film as an electrode.

10. A method as claimed in claim 9, wherein the metal thin film is formed to a thickness of between 0.05 and 1.0 microns.

11. A method as claimed in claim 9, wherein the water-repellent film is formed to a thickness of between 0.01 and 5.0 microns.

12. A method as claimed in claim 8, wherein the thermal-resistant resin plate is formed to a thickness of between 20 and 80 microns.

13. A method as claimed in claim 1, wherein said ink channels are formed to a width in the range of 100 to 2000 microns and the at least one through-hole is formed to a dimension of 300 to 600 microns wide by 600 to 1,000 microns long, and wherein, when a plurality of through-holes are provided, one through-hole is provided for every 100 to 300 nozzles.

14. A method as claimed in claim 1, wherein the frame is formed with:

a plurality of ink holes provided for covering a plurality of through-holes aligned on the second surface of the head chip; and a plurality of ink supply ports connecting the plurality of ink holes.

15. A method as claimed in claim 1, wherein the plurality of head chips are mounted to the frame.

16. A method as claimed in claim 1, wherein the head is mounted in a recording device.

17. A method as claimed in claim 1, wherein the partition wall is formed of polyimide.

18. A method for fabricating an ink ejection head including steps of:

providing a frame having a predetermined ink supply channel; and mounting a head chip on the frame, wherein the head chip is formed by steps comprising:

providing a silicon wafer;

forming a plurality of heaters comprising a thin-film conductor and a thin-film resistor formed on a first surface of the silicon wafer;

forming a drive large-scale-integrated circuit (LSI) on the first surface of the silicon wafer and connecting the drive LSI to each heater with a corresponding conductor, said drive LSI for applying pulses of energy to a corresponding heater to generate heat at a surface of the corresponding heater;

forming an orifice plate on the first surface of the silicon wafer, the orifice plate having a plurality of nozzles, each nozzle extending perpendicular to the surface of a corresponding heater so that bubbles generated by heat at the surface of each heater eject ink droplets through the nozzles;

providing a plurality of individual ink channels on the silicon wafer in correspondence with each of the nozzles;

providing a common ink channel on the silicon wafer connecting all the individual ink channels;

providing an ink groove in the silicon wafer connected with an entire length of the common ink channel; and forming a partition wall including the ink channels and at least one through-hole in the first surface of the silicon wafer, said at least one through-hole being formed through a second surface of the silicon wafer, which is opposite the first surface of the silicon wafer, to connect the ink groove to the first surface, said ink groove and said at least one through-hole being formed by silicon anisotropic etching from both a first side and a second side of the silicon wafer.

19. A method as claimed in claim 18, wherein the partition wall is formed of polyimide, and wherein said nozzles are formed by photoetching, said ink groove and said at least one through-hole being formed simultaneously.

* * * * *